US007191569B2

(12) United States Patent
Brown

(10) Patent No.: US 7,191,569 B2
(45) Date of Patent: Mar. 20, 2007

(54) TELESCOPING PIER FOUNDATION

(75) Inventor: Michael Jerry Brown, Warner Robins, GA (US)

(73) Assignee: Telecopier Foundations LLC, Atlanta, GA (US)

( * ) Notice: Subject to any disclaimer, the term of this patent is extended or adjusted under 35 U.S.C. 154(b) by 21 days.

(21) Appl. No.: 10/797,615

(22) Filed: Mar. 10, 2004

(65) Prior Publication Data

US 2004/0231257 A1 Nov. 25, 2004

Related U.S. Application Data

(60) Provisional application No. 60/453,323, filed on Mar. 10, 2003.

(51) Int. Cl.
*E02D 27/00* (2006.01)

(52) U.S. Cl. ..... 52/293.3; 52/157; 52/126.6; 52/296; 52/298; 52/111; 52/738.8

(58) Field of Classification Search ..... 52/292, 52/157, 126.6, 263, 293.3, 295, 296, 298, 52/DIG. 11, 297, 294, 111, 738.1, 737.5, 52/123.1, 165, 126.5; 405/231, 232, 233, 405/249, 257

See application file for complete search history.

(56) References Cited

U.S. PATENT DOCUMENTS 3,282,001 A * 11/1966 Bigalow ..... 52/292
3,630,474 A * 12/1971 Minor ..... 52/98
3,653,169 A * 4/1972 Jenner ..... 52/298
3,713,259 A * 1/1973 Tkach ..... 52/111
3,795,465 A * 3/1974 Burkland ..... 425/63
3,918,225 A * 11/1975 Fisher et al. ..... 52/125.1
4,125,975 A 11/1978 Soble
4,185,940 A * 1/1980 Spies ..... 405/288
4,255,071 A * 3/1981 Koppers et al. ..... 405/290
4,405,262 A * 9/1983 Nagashima ..... 405/221
4,429,497 A * 2/1984 Dibernardi ..... 52/27
4,923,165 A * 5/1990 Cockman ..... 248/545
5,363,610 A * 11/1994 Thomas et al. ..... 52/167.8
5,509,237 A * 4/1996 Coulter ..... 52/126.6
5,515,655 A * 5/1996 Hoffmann ..... 52/126.6
5,595,366 A * 1/1997 Cusimano et al. ..... 248/354.3
5,791,097 A 8/1998 Winston et al.
5,862,635 A * 1/1999 Linse et al. ..... 52/126.6
6,183,167 B1 2/2001 Ruiz et al.
6,213,684 B1 4/2001 Fowler et al.

* cited by examiner

*Primary Examiner*—Naoko Slack
*Assistant Examiner*—Chi Q. Nguyen
(74) *Attorney, Agent, or Firm*—Duane Morris LLP

(57) ABSTRACT

A telescoping pier foundation system (100, 100*a*, 100*b*) comprises generally an outer shell preferably made of a tough material, such as, a suitable polymer or a metal alloy, having an internal cavity (12) for receiving cementitious mixture. The outer shell comprises a stationary portion (10) and at least one longitudinally telescoping member (30) in longitudinal alignment with one another and connected to one another to achieve a given height, length or depth for forming a pier foundation. After the at least one telescoping member (30) is raised to meet a structural member (80, 80*a*) of a building and secured to the structural member, the internal cavity (12) of the outer shell is filled with cementitious mixture and cured to form a composite pier foundation.

41 Claims, 14 Drawing Sheets

TELESCOPING PIER FOUNDATION

CROSS REFERENCE TO RELATED APPLICATIONS

This application claims the benefit of U.S. Provisional Patent Application Ser. No. 60/453,323, filed on Mar. 10, 2003, which is incorporated herein by reference.

FIELD OF THE INVENTION

The present invention is directed generally to building foundation supports, and more particularly to a telescoping pier foundation system for forming support foundations for buildings such as manufactured homes.

BACKGROUND

Certain housing structures are typically prefabricated off-site and in sections consisting of multiple segments, transported to the building site, and then fastened together and placed on foundations. Such housing structures or houses are generally referred to as manufactured homes. In the construction of manufactured homes, because of economic constraints, the foundation systems used are typically very simple pier foundations. Pier foundations generally support homes on short columns attached to small concrete blocks. Some examples of such pier foundations are precast piers, concrete tube piers and concrete block piers. These types of support foundations provide minimal structural support. For example, it is known that these types of foundations provide little or no resistance to the uplift loads created by high wind events. Further, these blocks are often placed without the use of mortar, providing virtually no means for resisting the lateral loads created by both wind and seismic activity. Thus, a pier foundation system capable of withstanding continual axial compressive loads while resisting lateral load forces, and that is fast, easy to install, and adaptable to various foundation size requirements, is highly desired.

SUMMARY OF THE INVENTION

To address the above need for low-cost, easy to install, yet strong foundation systems, a telescoping pier foundation system according to an aspect of the present invention is disclosed. The telescoping pier foundation system comprises a stationary portion of a hollow structure having a top end opening and at least one telescoping member also of a hollow structure having a top open end and a bottom open end. The stationary portion and the at least one telescoping member are in longitudinal alignment with one another. The telescoping member resides within the top end opening of the stationary portion and is longitudinally movable within the top end opening. The stationary portion and the telescoping member form an outer shell having an internal cavity for receiving a cementitious mixture through one or more fill ports provided therein.

The telescoping member is telescopingly movable in longitudinal direction within the top end opening of the stationary portion and allows the height of the telescoping pier foundation system to be customized to the height of a structural member of a building to be supported. According to another embodiment of the present invention, the stationary portion may comprise a base and a column portion, the base portion having a larger transverse cross-sectional area than the column portion.

In one embodiment of the present invention, a fastening system is provided near the top end of the telescoping member for attaching or securing the telescoping member to a structural member of a building, such as, a floor I-beam of a manufactured home. After the telescoping member is secured to a structural member of a building, the internal cavity of the outer shell is filled with a high-strength cementitious mixture, such as concrete. The outer shell is provided with at least one fill port for pumping or pouring the cementitious mixture into the internal cavity. Upon curing of the cementitious mixture, the telescoping pier foundation system forms a composite pier foundation, supporting the structural member of the building, that comprises a tough outer shell and a solid inner core of the cementitious material substantially filling the internal cavity.

In another embodiment of the present invention, the telescoping pier foundation system may include one or more ground anchors for anchoring the base of the pier foundation to the ground to enhance the overall structural integrity of the finished building structure. The one or more ground anchors are first driven into the ground with their top portions remaining above ground. The outer shell of the telescoping pier foundation system of the present invention, whose bottom end is open, is then placed over the ground anchors with the bottom edges of the outer shell flush to the ground. The top portion of the ground anchors extend into the internal cavity of the outer shell, and when the internal cavity is filled with a cementitious mixture, such as concrete, the top portions of the ground anchors are imbedded within the concrete and become an integral part of the pier foundation.

According to another aspect of the present invention, a method of installing or deploying the telescoping pier foundation system is also disclosed. The telescoping pier foundation system's outer shell is positioned under a structural member, such as a floor I-beam, of a building to be supported. The outer shell is placed so that its base is at or below the frost line. The at least one telescoping member is then raised until the top of the telescoping member contacts the structural member of the building. The telescoping member is then secured to the structural member of the building using one or more fastening devices provided on the telescoping member. Next, the internal cavity of the outer shell is filled with a cementitious mixture by pumping or pouring the cementitious mixture through one or more fill ports provided on the outer shell and allowed to cure. Upon curing of the cementitious mixture, a composite pier foundation comprising an outer shell and an inner core of hardened cementitious material is formed.

According to another embodiment of the present invention, one or more ground anchors may be first fixed into the ground at the location for a pier foundation before the outer shell of the telescoping pier foundation system is placed. When the outer shell is placed in position over the ground anchors, the top portions of the ground anchors extend into the base of the outer shell. Thus, after the cementitious mixture is poured or pumped into the internal cavity of the outer shell and allowed to cure, the top portions of the ground anchors are imbedded in the cured cementitious mixture and the ground anchors become integral part of the resulting composite pier foundation.

Because the frost line depth varies from one geographical location to another, the depth to which pier foundations for structures such as manufactured homes must go down to reach the frost line will vary. The telescoping aspect of the pier foundation system of the present invention allows the height of the pier foundation to be customized to the needs of a particular installation easily and can be used in a variety of geographical locations. Furthermore, because the ground conditions at building installation sites never present a perfectly level ground conditions, requiring each of the several pier foundations to be installed with different heights, the robust telescoping feature of the pier foundation system of the present invention is generally much simpler to install than any conventional pier foundation systems.

The system according to an aspect of the present invention is optimal for application of a foundation system for manufactured homes that would be both structurally and economically superior to existing alternatives. The telescoping pier foundation system could also be used for new construction, structural repair, structural retrofit, and rehabilitation. This versatile device is capable of providing manufactured homes or other buildings with the structural stability of permanent homes/buildings, resulting in a safer form of low-income housing. In addition, this system can be readily adapted for use in the repair of traditional raised and slab foundations.

BRIEF DESCRIPTION OF THE DRAWINGS

Further features of the invention will be apparent from the following illustrations and description of various embodiments of the invention in which.

The features shown in the above referenced drawings are not intended to be drawn to scale nor are they intended to be shown in precise positional relationship.

DETAILED DESCRIPTION OF THE INVENTION

Figure 1A:
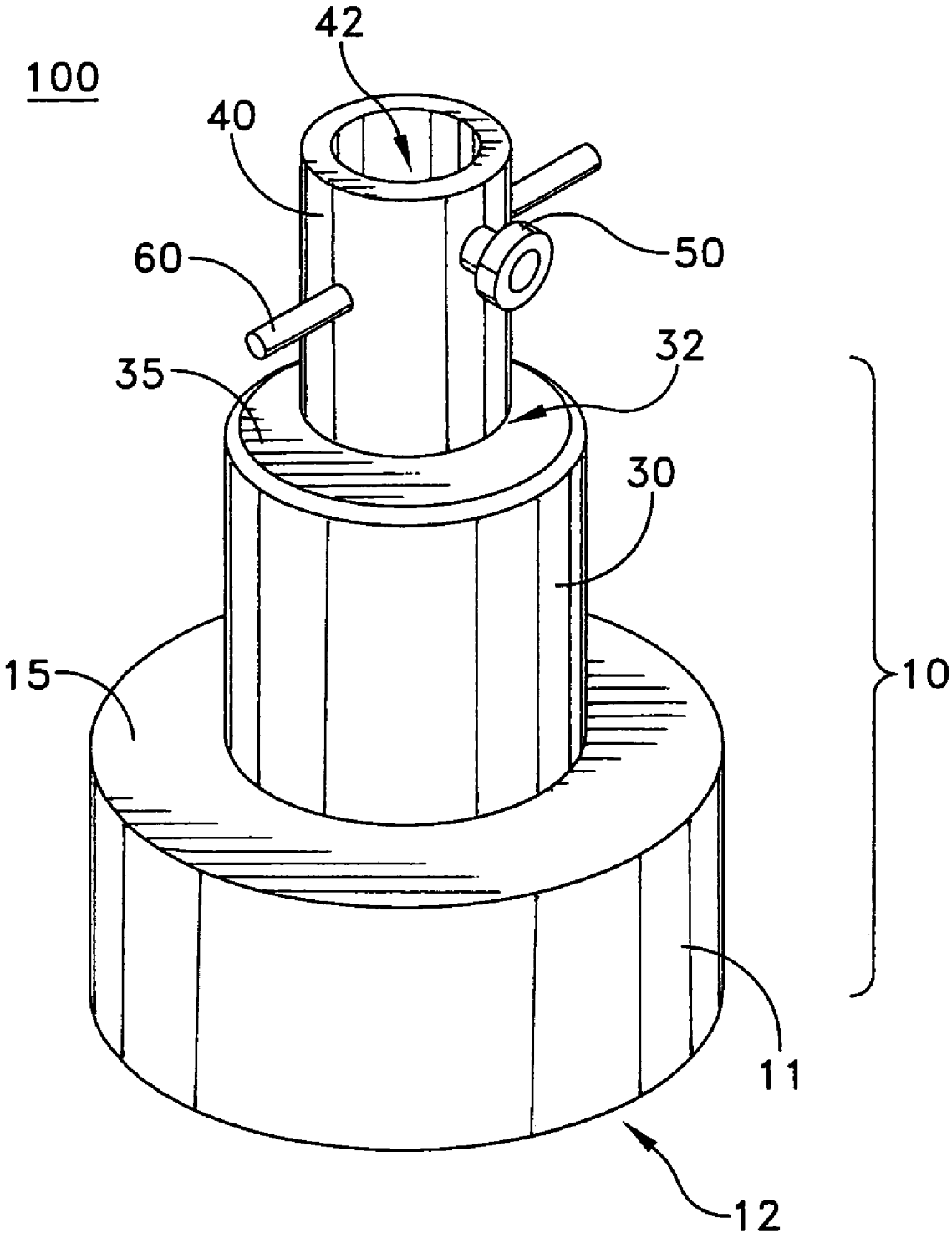
FIG. 1A is a perspective view of a telescoping pier foundation system according to an embodiment of the present invention.
Figure 3:
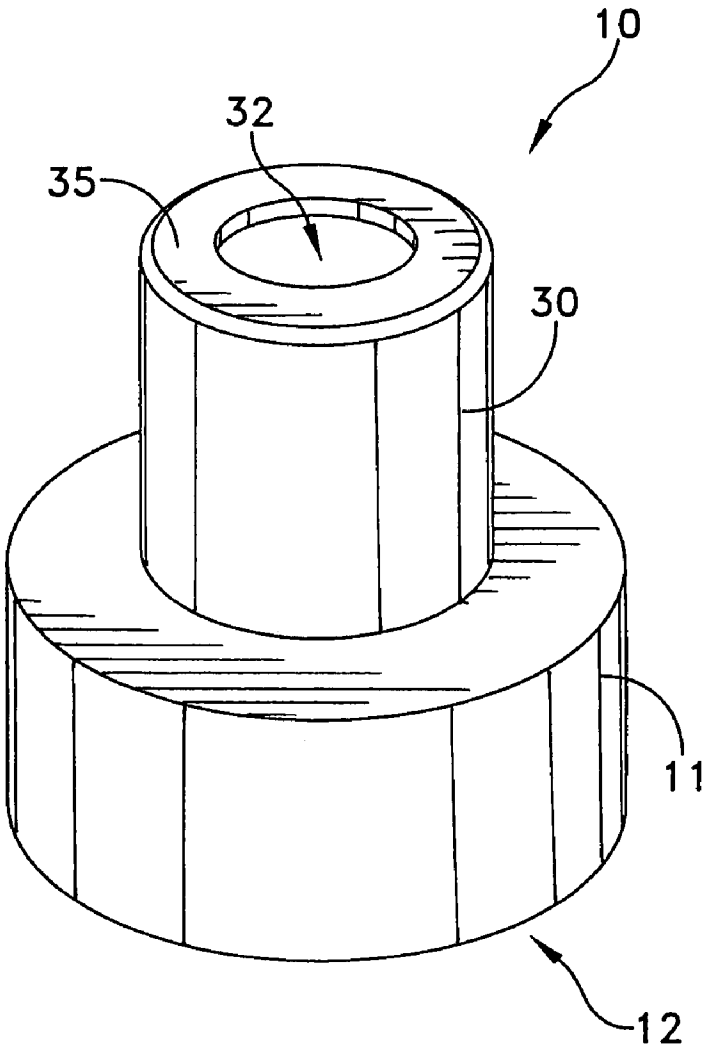
FIG. 3 is a perspective view of the base and the column portion of the telescoping pier foundation system of FIG. 2.

Referring to the Figures wherein like reference numerals indicate like elements, there is shown in FIG. 1A a telescoping pier foundation system 100 for forming a supporting foundation or a footing for buildings, such as, homes, manufactured homes, etc. The telescoping pier foundation system 100 comprises an outer shell comprising a stationary portion 10, of a hollow structure, from which at least one longitudinally telescoping member 40, also of a hollow structure open at both ends for setting the height of the resulting pier foundation, extends. In this example, the stationary portion 10 comprises a base 11 and a column portion 30 having a smaller diameter than the base 11. These components of the outer shell, which in one embodiment include the base 11, the column portion 30 and the telescoping member 40 are all hollow structures and, in combination, form the outer shell for the telescoping pier foundation system 100. More detailed illustrations of exemplary embodiments of these components of the outer shell are shown in FIGS. 2 and 3.

Figure 2:
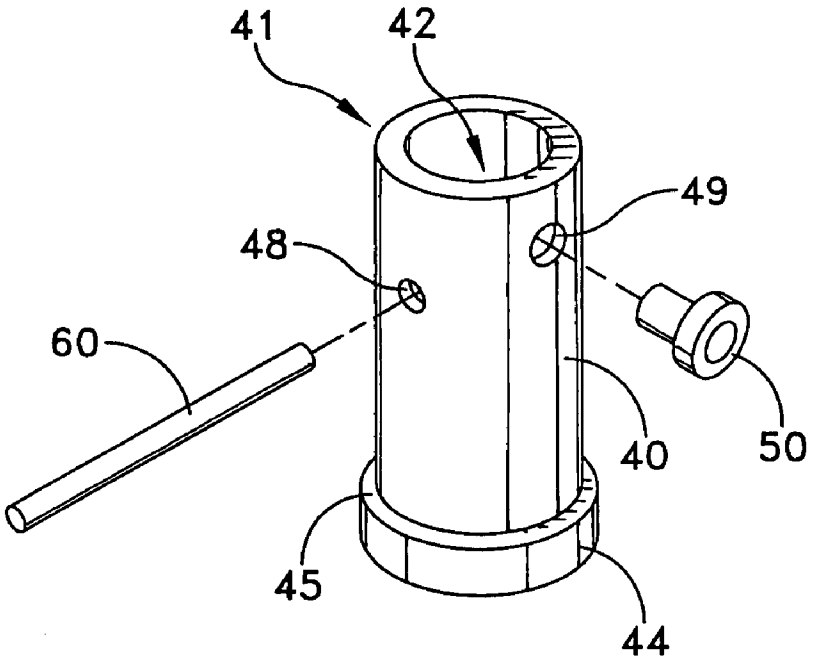
FIG. 2 is a perspective exploded view of the telescoping member of the telescoping pier foundation system of FIG. 1.

Shown in FIG. 2 is an exploded view of the telescoping member 40 according to an embodiment of the present invention. The telescoping member 40, in this example, is a hollow cylindrical structure as shown, but in other embodiments of the present invention, may also be other shapes, such as, a tubular structure having an oval, square, or other polygonal cross-sectional shapes. The telescoping member 40 has a flange portion 44 at the bottom end. The flange portion 44 has a larger diameter than the rest of the telescoping member 40 and, thus, presents a substantially flat transverse surface 45. Shown in FIG. 3 is the stationary portion 10 comprising the base 11 and the column portion 30. The stationary portion 10 is open on the bottom side so that the internal cavity 12 is accessible from the bottom side. The top end of the column portion 30 has a top surface 35 in which is provided an opening 32 for receiving the telescoping member 40. The telescoping pier foundation system's outer shell is assembled by inserting the telescoping member 40 through the opening 32 from the bottom side with the top end 41 of the telescoping member 40 first. The opening 32 has a diameter that is substantially equal to the outside diameter (O.D.) of the telescoping member 40 so that the telescoping member 40 fits snugly within the opening 32. The snugness of this fit need not be air tight, but should be loose enough to allow the telescoping member 40 to be moved up and down easily and at the same time snug enough to keep the cementitious mixture from seeping out. Note, however, that the present invention contemplates additional means to reduce seepage, for example, a retaining ring or gasket to seal the device. After the telescoping member 40 is inserted into the opening 32, a connecting rod 60 and a fill port 50 are inserted into holes 48 and 49, respectively.

Figure 5:
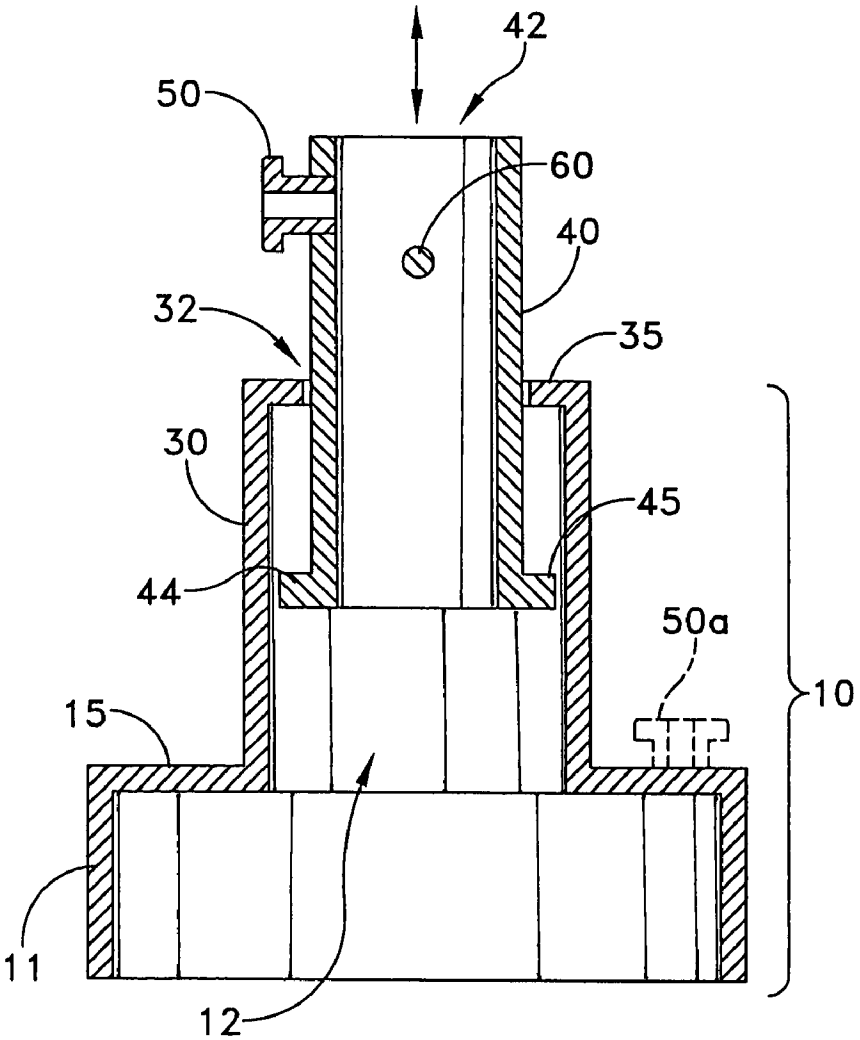
FIG. 5 is a cross-sectional view taken along A—A of FIG. 4.
Figure 4:
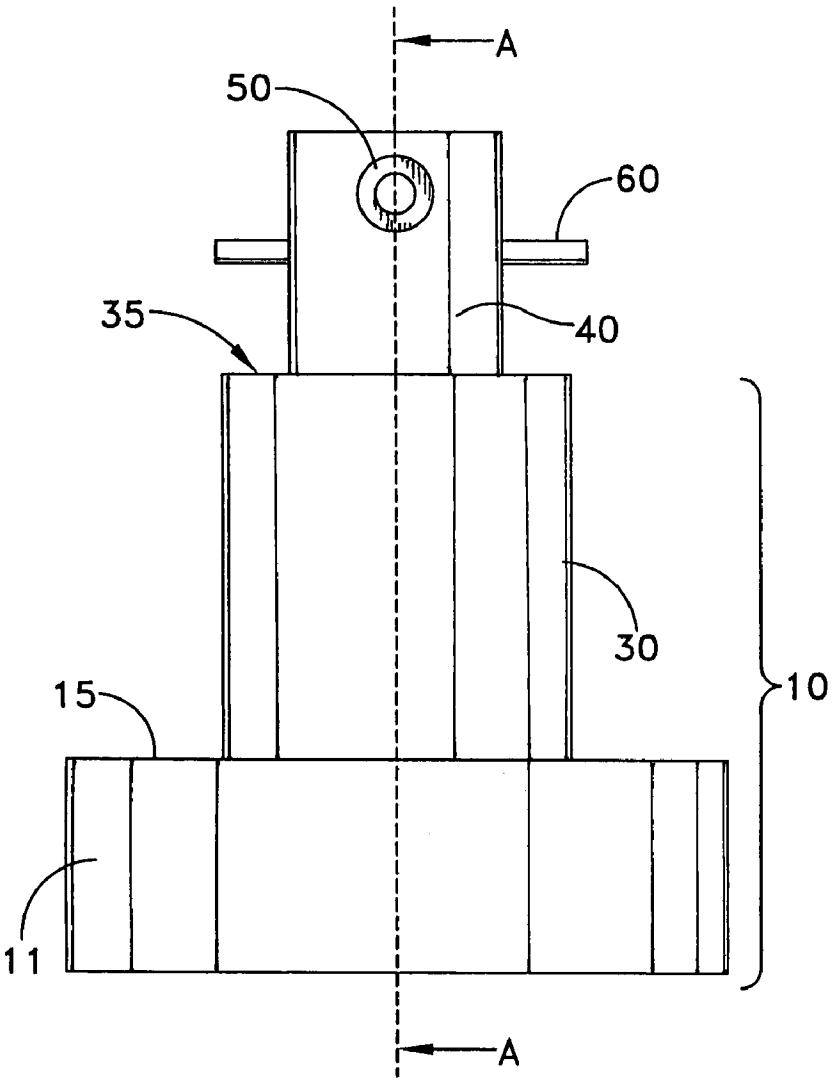
FIG. 4 is a side view of the telescoping pier foundation system of FIG. 1.

When fully assembled, the telescoping member 40 resides within the top opening 32 of the column portion 30 and the flange portion 44 of the telescoping member 40 limits the upward movement of the telescoping member 40. The flange portion 44 of the telescoping member 40 has a diameter that is sufficiently larger than the O.D. of the telescoping member 40 so that the transverse surface 45 of the flange portion 44 will interfere with the top surface 35 of the column portion 30 and prevent the telescoping member 40 from completely being removed from the opening 32 when the telescoping member 40 is telescopically raised through the opening 32. This is better illustrated in the cross-sectional view of the assembly in FIG. 5. FIG. 5 is a cross-sectional view of the outer shell of the telescoping pier foundation system 100 through line A—A of FIG. 4. The transverse surface 45 will butt up against the top surface 35 and prevent the telescoping member 40 from being completely removed through the opening 32. Although this is not a necessary feature of the telescoping pier foundation system of the present invention, it makes using and handling the pier foundation system easier by keeping the components together. Similarly, the telescoping member 40 is prevented from completely falling into the column portion 30 because the fill port 50 and/or the connecting rod 60 protrude from the telescoping member 40 and will interfere with the top surface 35.

Figure 5A:
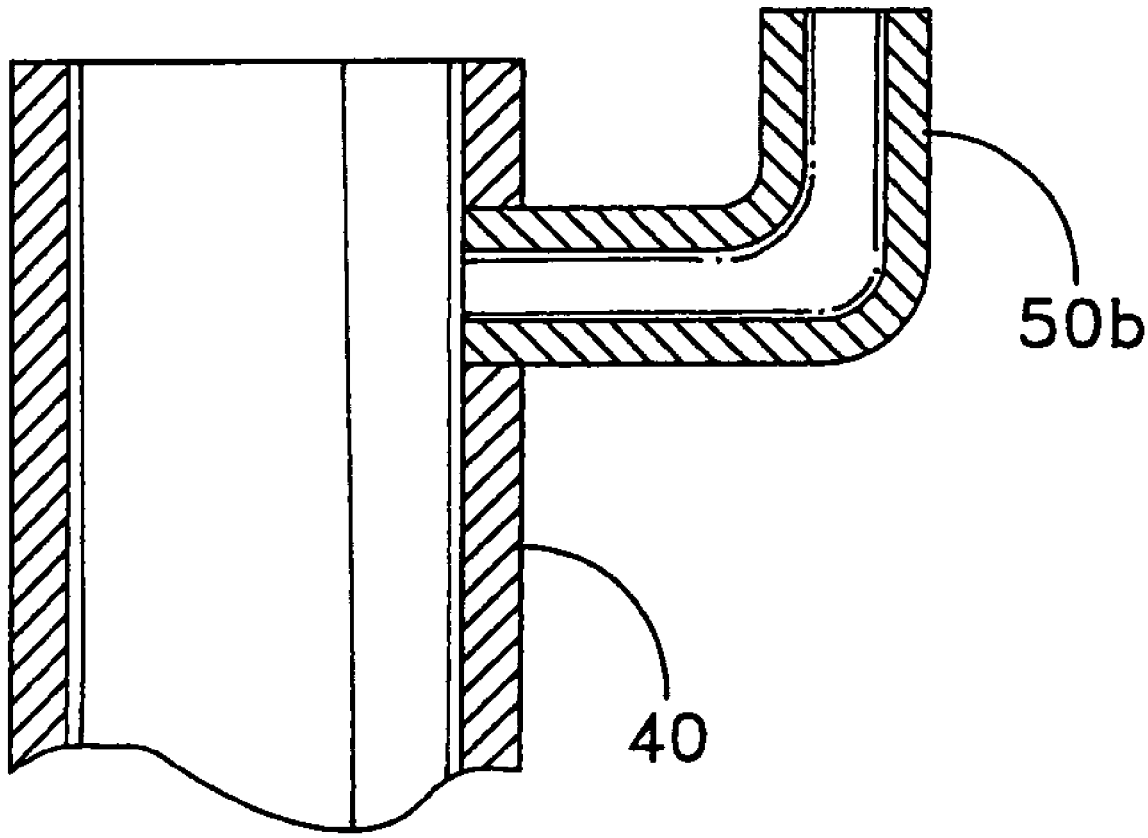
FIG. 5A is a cross-sectional view of a telescoping member having an embodiment of a fill port.

The outer shell comprises at least one fill port 50 for pumping or pouring cementitious mixture into the internal cavity 12 of the telescoping pier foundation system. In one embodiment of the present invention, the fill port 50 may be a check valve to prevent the cementitious mixture from flowing back out. The fill port 50 is preferably located near the top end of the telescoping member 40 so that the internal cavity 12 can be filled to the brim of the telescoping member 40 as much as possible. This is usually preferable since the pier foundation should preferably have a solid core of cementitious material. However, depending upon the application, the internal cavity 12 may only be partially filled with the cementitious mixture. The fill port 50 may also be any other suitable valve or simply a properly oriented opening that will allow filling of the internal cavity 12 with the cementitious mixture. For example, FIG. 5A illustrates a fill port 50*b* located near the top of the telescoping member 40 oriented upwardly so that the cementitious mixture can be filled to the brim of the telescoping member 40. In another embodiment of the present invention, if the top end opening 42 of the telescoping member 40 is accessible after installation (i.e., not blocked by a structural member of the building such as an I-beam), the top end opening 42 may function as a fill port for introducing the cementitious mixture into the internal cavity 12. If necessary, additional fill ports may also be provided at various points on the outer shell to ensure that the internal cavity 12 of the outer shell can be properly filled with the cementitious mixture. For example, FIG. 5 illustrates an optional fill port 50*a*, shown in phantom lines, provided on the base 11. The outer shell may be provided with one or more fill ports as necessary.

Figure 1C:
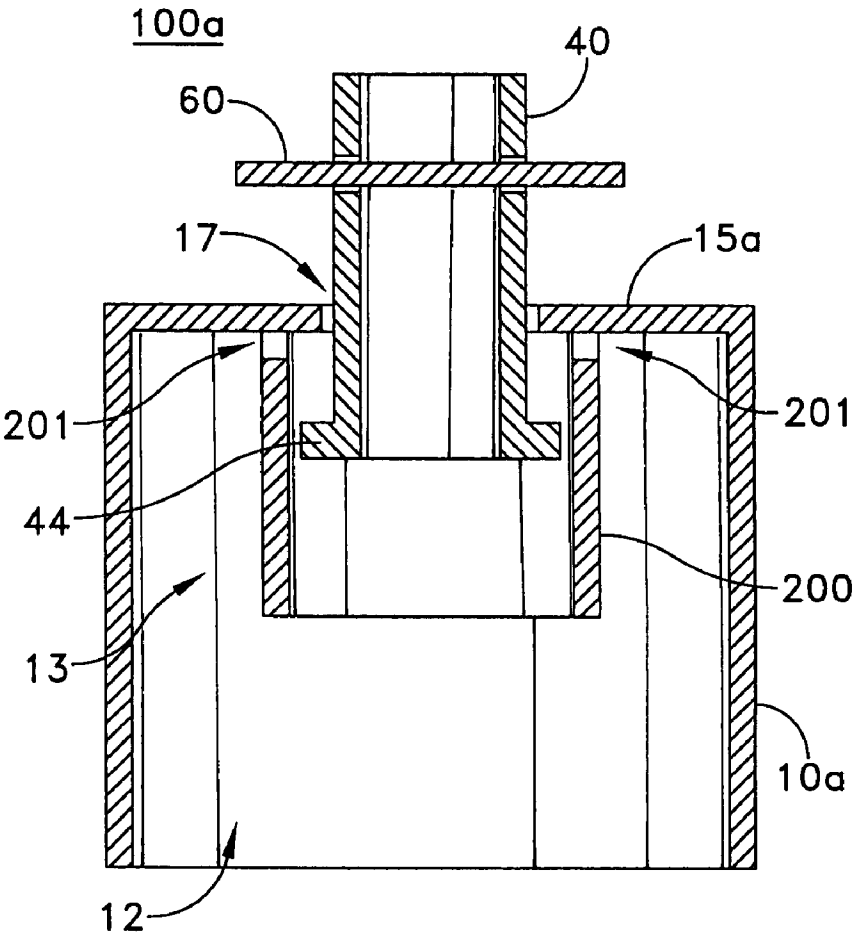
FIG. 1C is a cross-sectional view of the telescoping pier foundation system of FIG. 1B.
Figure 1B:
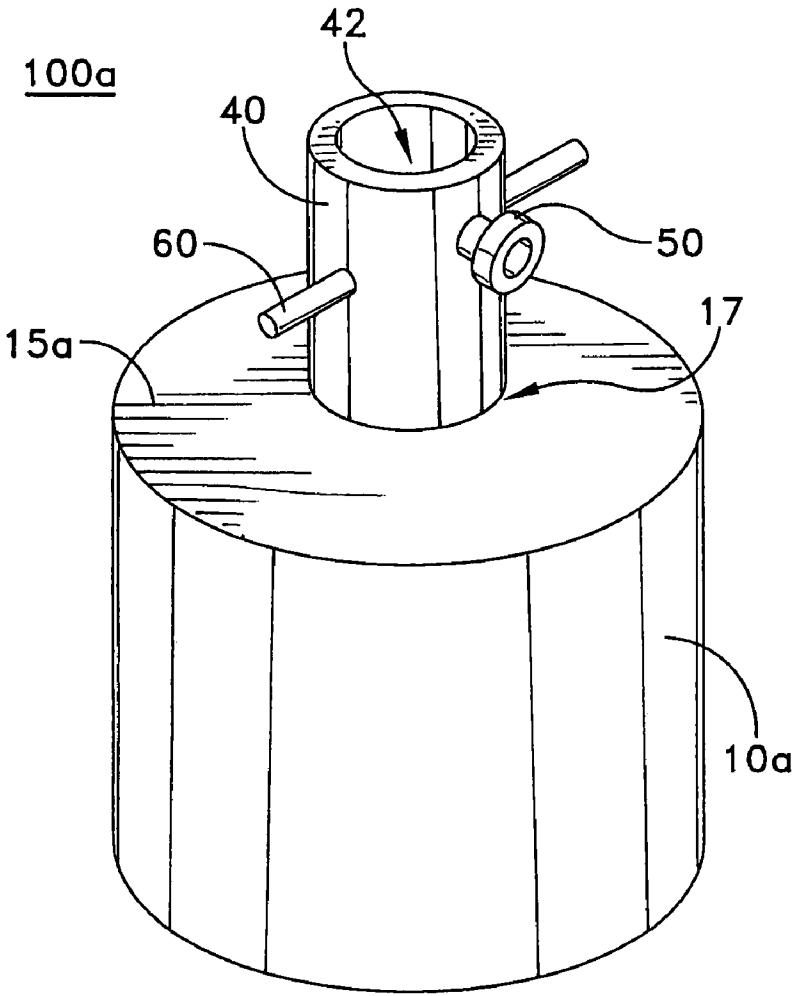
FIG. 1B is a perspective view of a telescoping pier foundation system according to another embodiment of the present invention.

Furthermore, it should be noted that the stationary portion 10 need not have a distinguishable base 11 and a column portion 30. As illustrated in the telescoping pier foundation system 100*a* in FIG. 1B, in another embodiment of the present invention, the base 11 and the column portion 30 from the pier foundation system of FIG. 1A are merged into one large stationary portion 10*a*. The telescoping member 40 extends telescopingly from the top surface 15*a* of the stationary portion 10*a* through a hole 17. The structure of the telescoping member 40 is same as that discussed in reference to the embodiment of the present invention illustrated in FIGS. 2–5. FIG. 1C is a cross-sectional illustration of the telescoping pier foundation system 100*a*. As shown, the flange portion 44 of the telescoping member 40 and the surface 15*a* will prevent the telescoping member 40 from being removed through the hole 17. In this embodiment of the present invention, because the inside diameter (I.D.) of the stationary portion 10*a* may be substantially larger than the O.D. of the telescoping member 40, a guiding surface 200 may be provided within the internal cavity 12. The I.D. of the guiding surface 200 should be larger than the O.D. of the flange portion 44 so that the telescoping member 40 can telescope up and down through the hole 17 within the confines of the guiding surface 200. The guiding surface 200 will keep the telescoping member 40 in an upright position throughout its telescoping range. Such guiding surface 200 would be provided with one or more venting holes 201 near the top so that when the internal cavity 12 is being filled with the cementitious mixture, the space 13 between the guiding surface 200 and the stationary portion 10*a* may be completely filled.

Figure 1D:
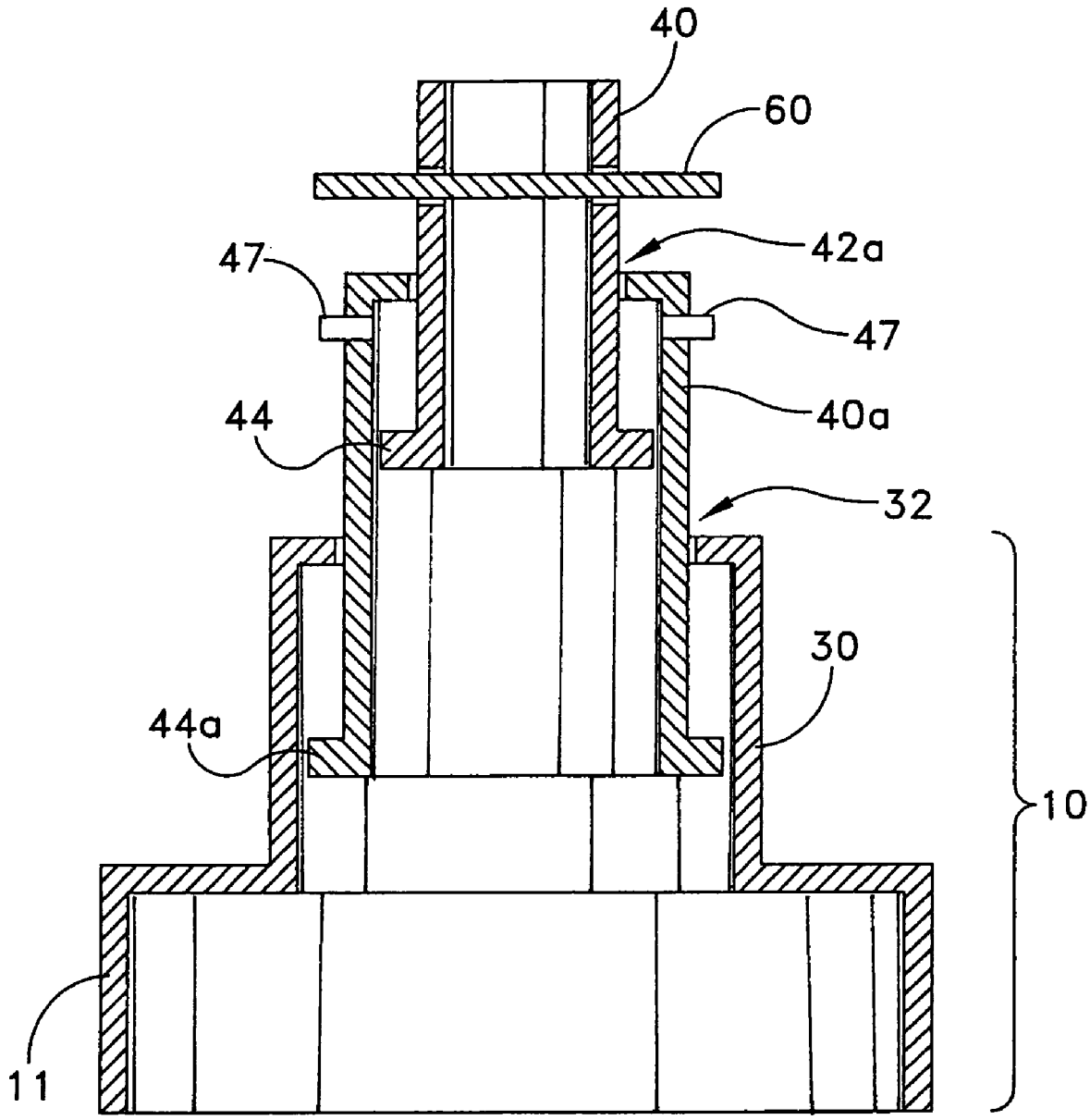
FIG. 1D is a perspective view of a telescoping pier foundation system according to yet another embodiment of the present invention.

It is understood that the telescoping pier foundation system according to another embodiment of the present invention may include multiple telescoping members longitudinally aligned and telescopingly connected with one another in order to increase the range of the variable height, length or depth of the telescoping pier foundation. FIG. 1D is an illustration of this embodiment. In this example, a second telescoping member 40*a* is provided between the telescoping member 40 and the column portion 30. The telescoping member 40 resides within the top end hole 42*a* of the second telescoping member 40*a*. Similar to the flange portion 44 of the first telescoping member 40, the second telescoping member 40*a* also has a flange portion 44*a* near its bottom end to prevent the second telescoping member 40*a* from completely being removed through the top end opening 32 of the column portion 30. The second telescoping member 40*a* may be provided with means for preventing it from dropping into the column portion 30. That means may be pins or studs 47, as illustrated or a ring-like structure fitted around the top end of the second telescoping member 40*a*.

Figure 6:
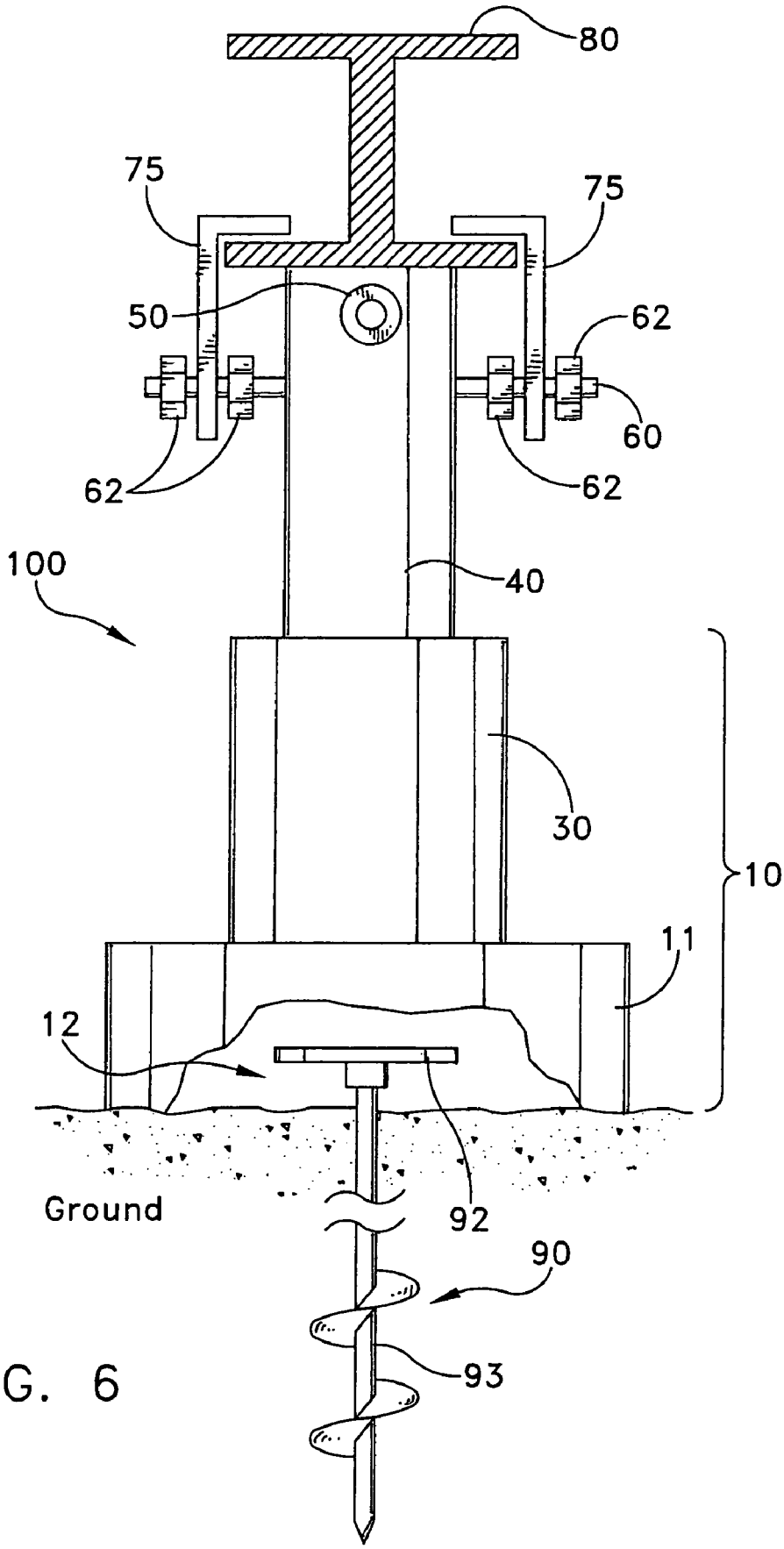
FIG. 6 is an illustration of an embodiment of the telescoping pier foundation system in an installed configuration including a ground anchor.

Referring to FIG. 6, a telescoping pier foundation system 100 of FIG. 1A in an installed configuration will be described. The telescoping pier foundation system 100 is positioned beneath a structural member of a manufactured home, namely a floor I-beam 80, in such a manner so that the base 11 is sitting on the ground substantially level and flush to the ground. The telescoping member 40 has been raised telescopically so that the top of the telescoping member 40 comes in contact with the bottom surface of the I-beam 80. The telescoping member 40 may be provided with a fastening system for securing the telescoping member 40 to the structural member of the building. An example of such a fastening system is illustrated in FIG. 2. In this example, the fastening system of the telescoping member 40 comprises a pair of diametrically opposed holes 48 provided in the telescoping member 40 through which a connector 60, such as a rod, pin, or a threaded bolt is placed to span the width of the telescoping member 40. Referring back to the illustration of FIG. 6, the ends of the connector 60 extend out from the telescoping member 40 a distance sufficient to allow the pier foundation system to be secured to the I-beam

Figure 7:
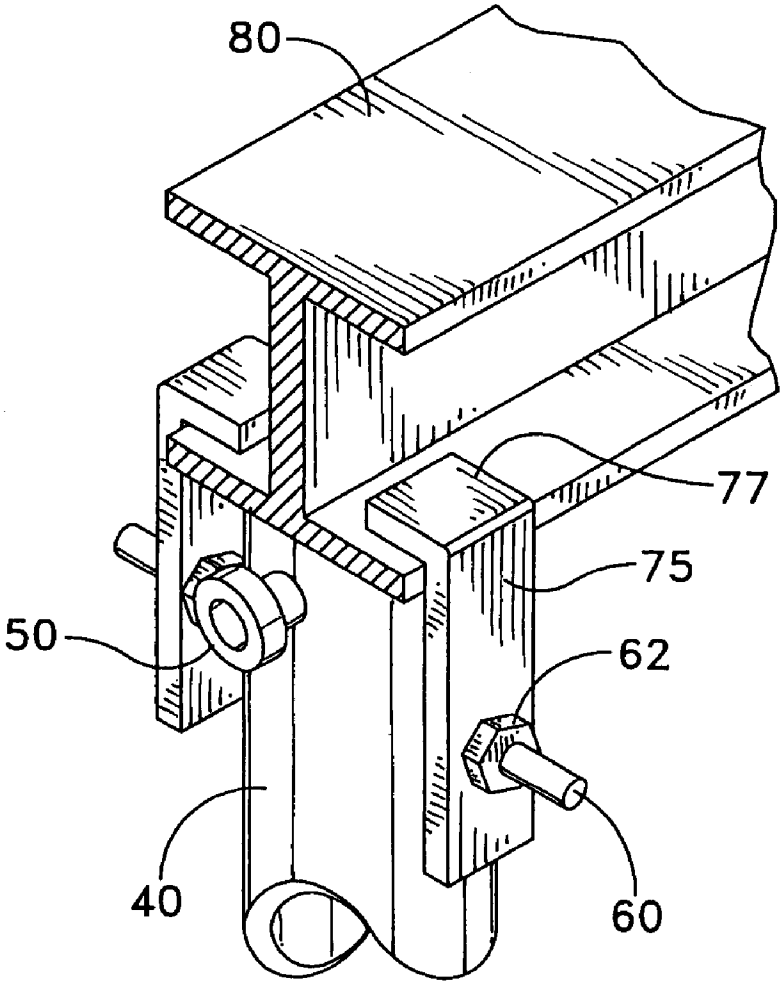
FIG. 7 is a perspective view of the telescoping member portion of the telescoping pier foundation system of FIG. 6.

80 by means of the connector 60 and a pair of brackets 75. FIG. 7 provides a perspective view of this connection arrangement. In a preferred embodiment, as illustrated here, the brackets 75 are inverted L-shaped bracket having a top portion 77 for engaging the I-beam 80 and a hole 72 for securing to the connector 60. The connector 60 in this example is a threaded bolt and, as illustrated in FIGS. 6 and 7, nuts 62 may be used to secure the brackets 75 to the connector 60. The brackets 75 may be made from a metal alloy, such as steel or structural aluminum alloy, of the type and thickness to provide the brackets 75 a sufficient tensile strength for this type of application. They should at least be strong enough to withstand the ultimate uplift loading limit for the resulting pier foundation. It should be noted that many different fastening devices may be used as the fastening system for securing the telescoping member 40 to the floor I-beam 80. For example, steel cables or steel straps may be used to secure the telescoping member 40 to the I-beam 80.

Figure 6A:
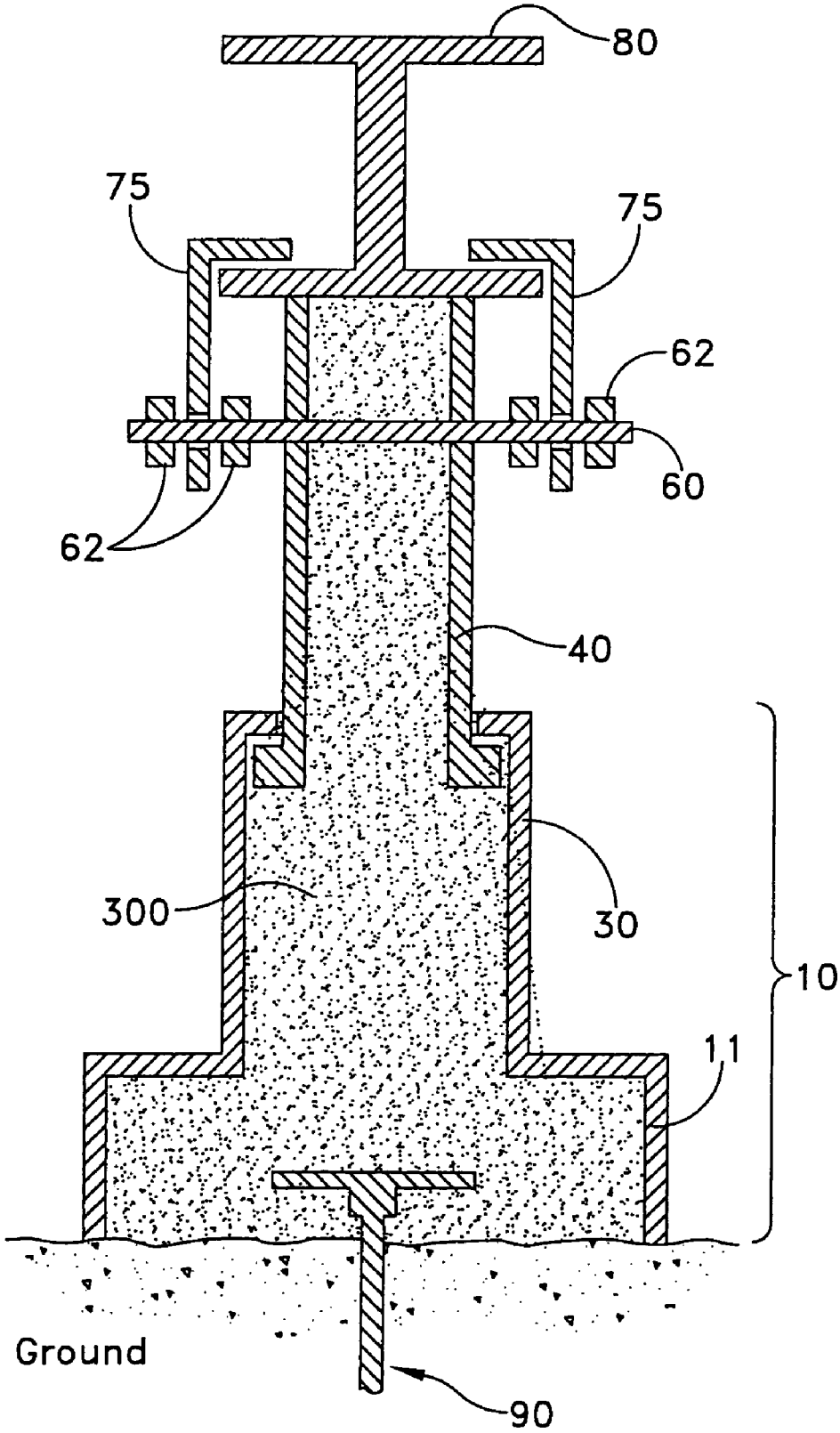
FIG. 6A is a cross-sectional schematic illustration of the telescoping pier foundation system of FIG. 6 filled with cementitious mixture.
Figure 8:
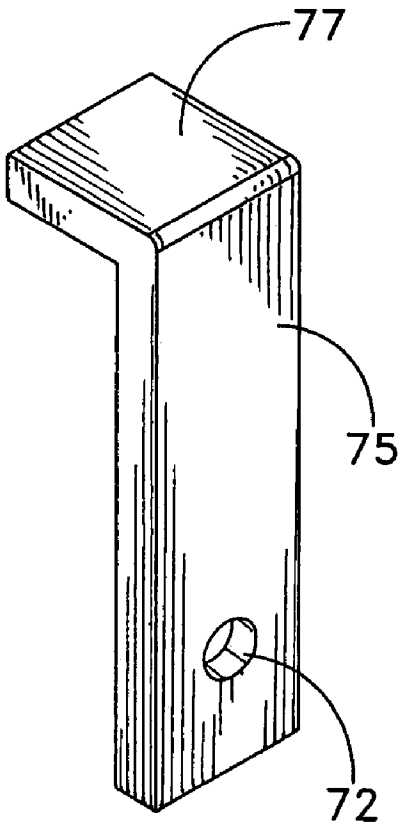
FIG. 8 is a perspective detailed illustration of an L-bracket for securing the telescoping pier foundation system to a building floor I-beam.

According to the present invention, after the telescoping member 40 is secured to the I-beam 80, cementitious mixture is pumped or poured through the fill port 50 and completely fill the internal cavity 12. Preferably, the internal cavity 12 is substantially completely filled with the cementitious mixture from the ground to top end of the telescoping member 40 butting up against the I-beam 80. This way, the outer shell of the pier foundation and the cured cementitious mixture 300 form a solid high-strength composite pier foundation, whose height has been custom fitted to the height from the ground to the I-beam 80. And because the composite pier foundation of the present invention is secured to the building structural I-beam 80 via the fastening system, the finished building structure can withstand higher uplift and lateral loads than buildings utilizing the conventional pier foundations. FIG. 6A is an cross-sectional illustration of a composite pier foundation formed by filling the internal cavity 12 of the telescoping pier foundation system 100 of FIG. 6 with cementitious mixture. The internal cavity of the pier foundation system is now filled with cured cementitious mixture 300.

Figure 8B:
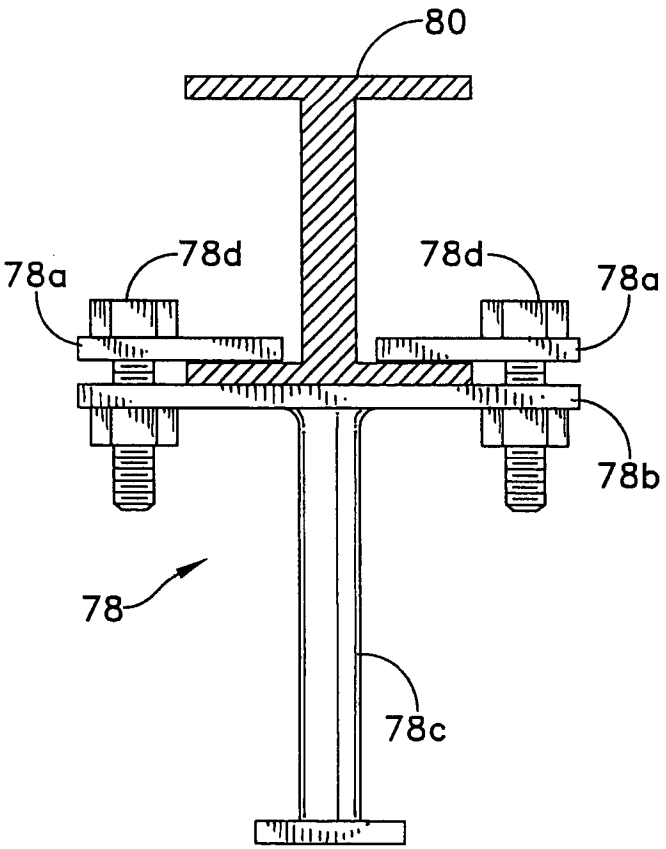
FIG. 8B is a side-view schematic illustration of the fastening system of FIG. 8A.
Figure 8A:
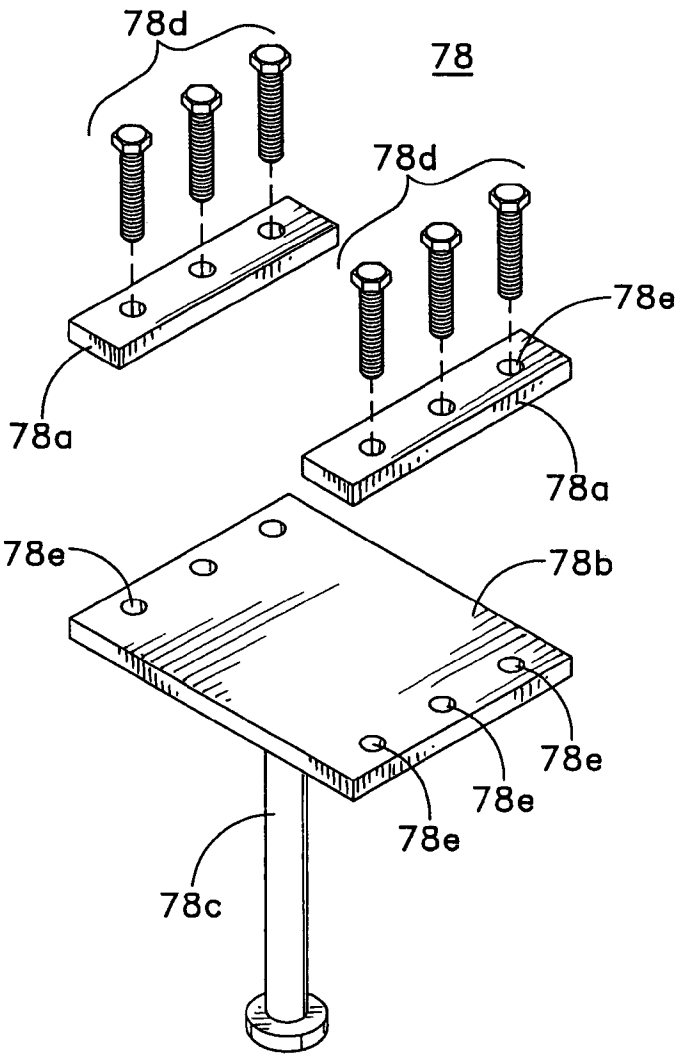
FIG. 8A is a perspective exploded view of a fastening system according to another aspect of the present invention.

Another example of a fastening system for the telescoping pier foundation system 100 may be a clamp that may be clamped to the building floor I-beam 80 on one end and anchored to the cementitious mixture filling the internal cavity 12 on the other end. FIG. 8A is an exploded perspective schematic illustration of such a fastening device 78. FIG. 8B is a side-view schematic illustration of the fastening device 78 secured to an I-beam 80. The fastening system of this embodiment comprises two or more cover plates 78*a* and a bottom plate 78*b* for securing to the I-beam 80. As illustrated in FIG. 8B, the bottom plate 78*b* is first butted up against the bottom surface of the base of the I-beam 80. The two or more cover plates 78*a* are then placed on the top surface of the base of the I-beam 80 sandwiching the base of the I-beam 80 between the cover plates 78*a* and the bottom plate 78*b*. The fastener 78 is then secured by nuts and bolts 78*d* through the holes 78*e* in the cover plates 78*a* and the bottom plate 78*b*. An anchoring rod portion 78*c* is provided on the under side of the bottom plate 78*b* for anchoring the fastening device 78 to the cementitious mixture filling the internal cavity 12 of the pier foundation system outer shell. The anchoring rod portion 78*c* extends into the internal cavity 12 through the top end opening 42 of the telescoping member 40 when installed. In an actual application, the fastening device 78 is first secured to an I-beam 80. Then, a telescoping pier foundation system 100 is positioned in place under the I-beam 80 so that the telescoping member 40 is butted up against the I-beam 80 with the anchoring rod portion 78*c* of the fastening device 78 being inside the telescoping member 40. After the internal cavity 12 of the telescoping pier foundation system 100 is filled with cementitious mixture and cured, the anchoring rod portion 78*c* will be imbedded within the cured cementitious mixture and the fastening device 78 becomes integral with the resulting pier foundation. When this type of fastening device is utilized, other fastening mechanisms described herein, such as the connecting rod 60 and the L-shaped brackets 75, may not be necessary.

For installations in locations prone to extreme and/or variable environmental forces, such as extremely high winds or seismic conditions, the telescoping pier foundation system according to a preferred embodiment of the present invention may include the use of one or more ground anchors. In the example of the telescoping pier foundation system illustrated in FIG. 6, one such ground anchor 90 is illustrated. The ground anchor(s) 90 is preferably helical anchor(s) and has a top portion 92 and a shaft portion 93. The top portion 92 remains above ground after the shaft portion 93 is driven into the ground. In applications where the ground anchor(s) 90 are used, the ground anchor(s) 90 are first driven into the ground so that when the pier foundation system 100 is positioned under the I-beam 80, the top portion(s) 92 of the anchor(s) 90 sit within the internal cavity 12. Thus, the top portion 92 is imbedded within the cementitious mixture and becomes an integral part of the composite pier foundation once the cementitious mixture is cured. By anchoring the base of the composite pier foundation to the ground, the building will be better protected from uplift and lateral loads. Preferably, the ground anchor(s) 90 may be installed at a slant approximately 20 to 30 degrees from the vertical and more preferably, slanted in direction perpendicular to the long axis of the building structure to maximize the lateral load capability of the building in the short axis direction.

In an exemplary embodiment of the present invention, the major components of the outer shell, base 10, the column portion 30, and the telescoping member 40 may be made of a hard, structurally durable material such as composite polymers (e.g. fiber reinforced plastic), polyvinylchloride (PVC), or a metal alloy such as steel or structural aluminum alloy. In a preferred embodiment of the present invention, the stationary portion 10 and the telescoping member 40 each may be made as unitary units by injection molding PVC. Alternatively, the outer shell components may be assembled from off-the-shelf PVC tubing, steel tubing, or aluminum alloy tubing of appropriate sizes and dimension.

Figure 9:
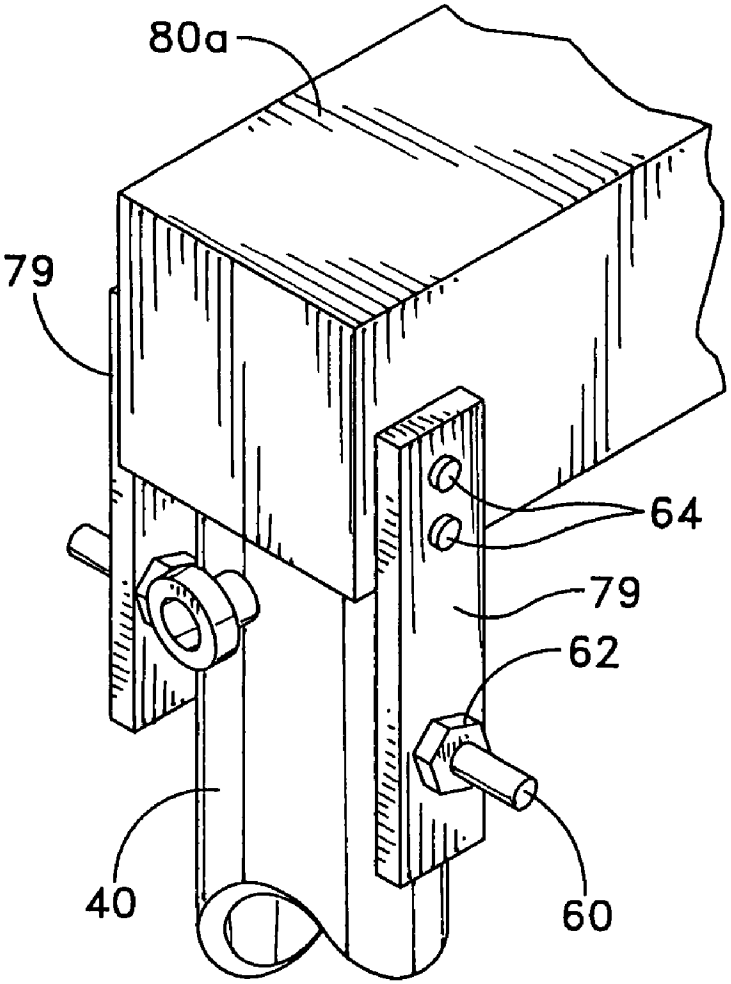
FIG. 9 is a perspective view of the telescoping member portion of a telescoping pier foundation system according to another embodiment of the present invention secured to a wooden structural beam.

According to another aspect of the present invention, the telescoping pier foundation system may be used to support a wooden beam rather than an I-beam. FIG. 9 illustrates such an example. The telescoping member 40 is secured to a wooden beam 80*a* using a pair of straight brackets 78. The bracket 78 is secured to the connector 60 at one end using threaded nuts 62 and secured to the wooden beam 80*a* at the other end by fastening means such as lag screws or lag bolts 64.

Figure 10:
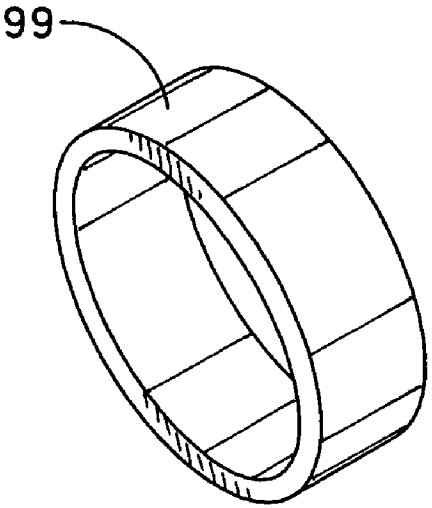
FIG. 10 is a perspective view of a cap for sealing the top end opening of the telescoping member portion of a telescoping pier foundation system according to another embodiment of the present invention.

In another embodiment of the present invention, the top end of the telescoping member 40 may be sealed off with a cap 99 as shown in FIG. 10. The cap may be provided with a weeping or a vent hole on its top surface to prevent a pocket of air being trapped under it as the internal cavity 12 of the telescoping pier foundation system is filled with a cementitious mixture.

The telescoping pier foundation system of the present invention effectively utilizes the compressive strength of cementitious mixture and the tensile strength of the tough outer shell. The cementitious mixture used to fill the internal cavity 12 of the telescoping pier foundation system may be high compressive strength (about 4000 psi) concrete typically used for building foundations, floor slabs, road ways and other heavy duty applications. The cementitious mixture, however, should have an appropriate viscosity to be pumped into the telescoping pier foundation system through the fill port(s).

Figure 11:
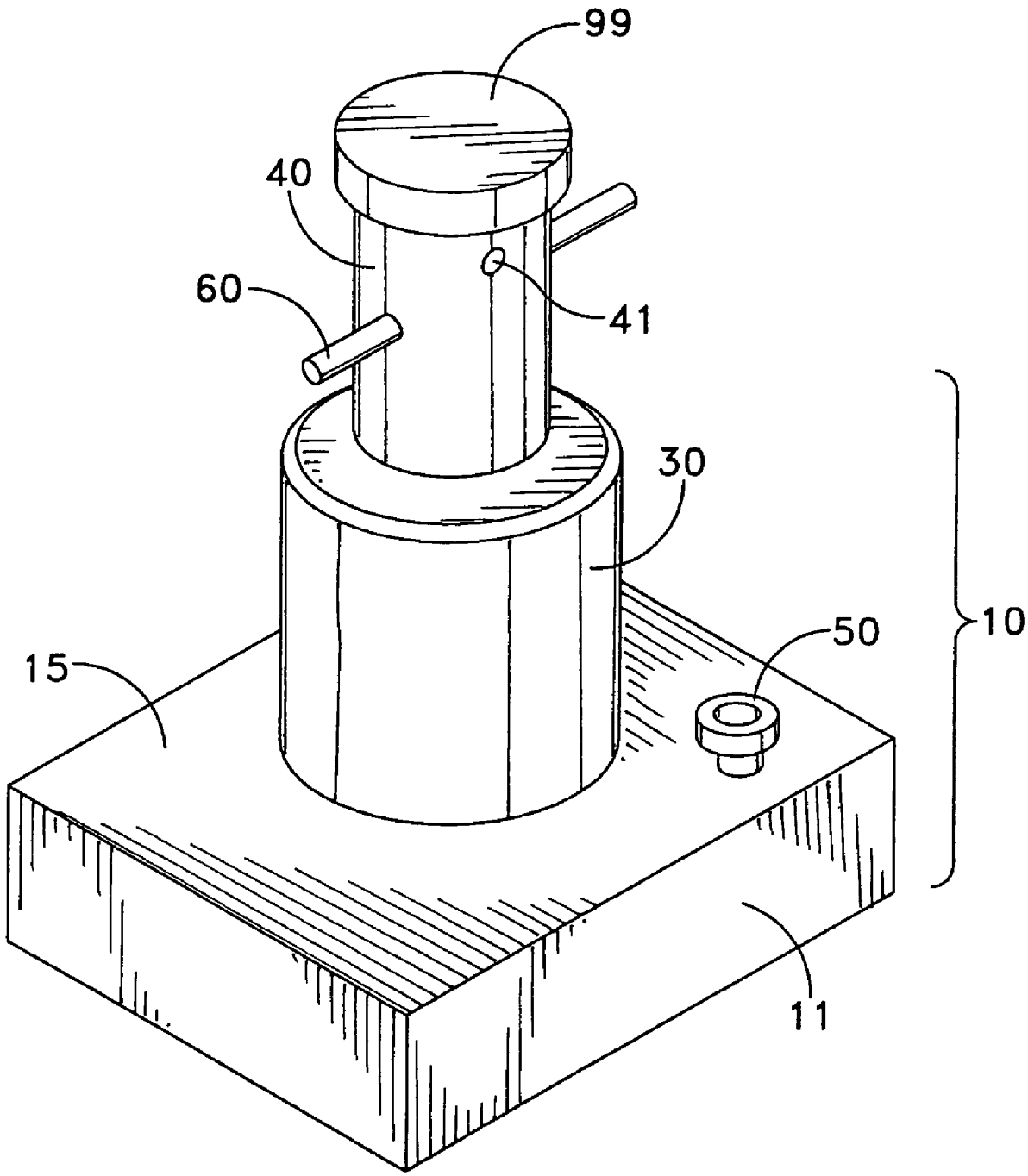
FIG. 11 is a perspective view of another embodiment of the telescoping pier foundation system of the present invention.

Referring to FIG. 11, another embodiment of the present invention is illustrated where the fill port 50 is provided on top surface 15 of base 11. Because the internal cavity would be filled from bottom up fashion in this example, a weep hole or a vent hole 41 may be provided near the top portion of the telescoping member 40. This is particularly necessary where the top end opening 42 of the telescoping member 40 is sealed off with a cap 99, as shown. If the top end opening 42 can be left open, the vent hole 41 may not be necessary. It should be further noted that the base 11 in this exemplary embodiment of the present invention has a square shape. As discussed above, the stationary portion 10 and the telescoping member 40 of the telescoping pier foundation system may be hollow structures having any one of a variety of cross-sectional shapes.

Figure 12:
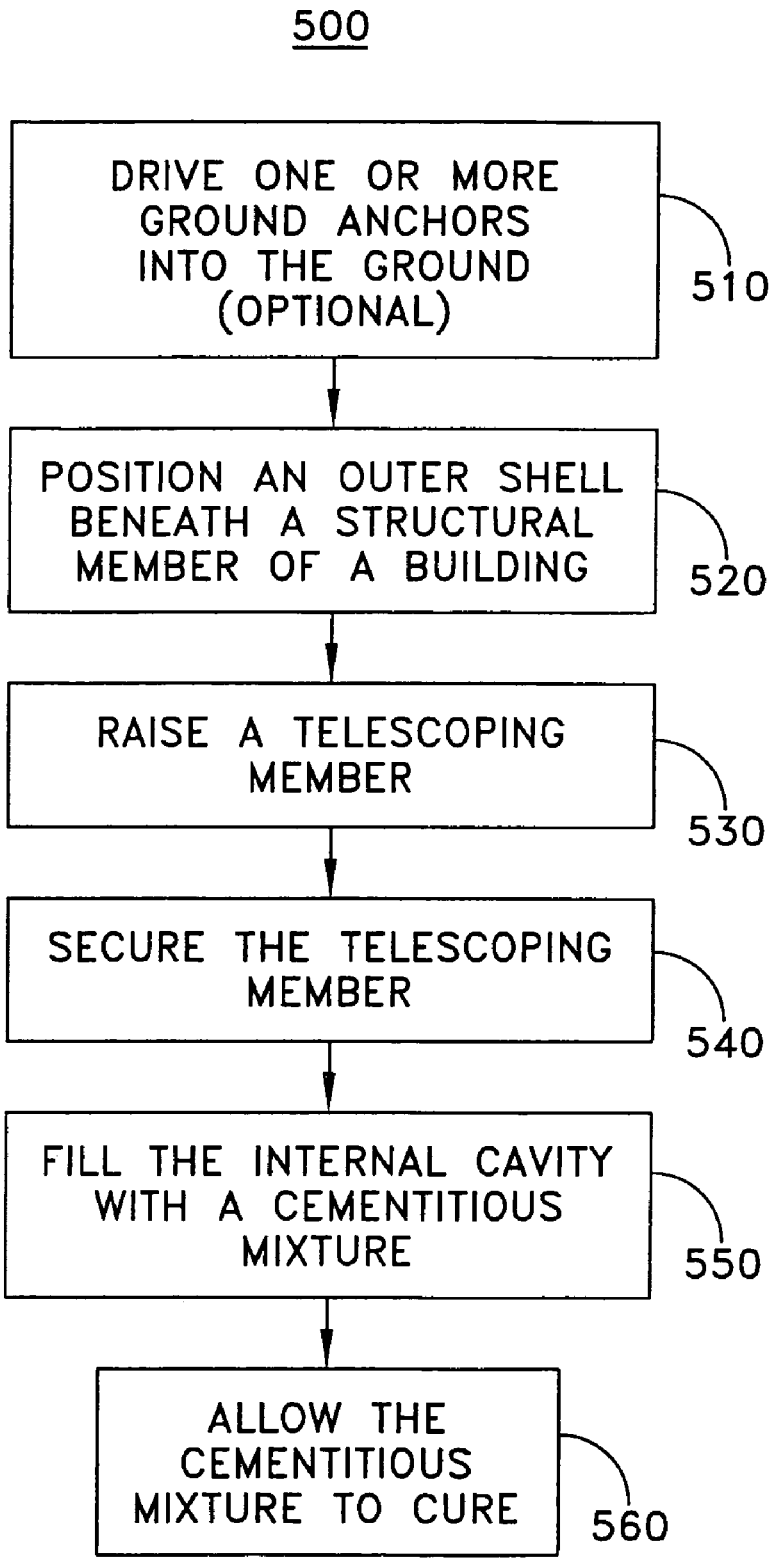
FIG. 12 is a flow chart illustrating a method of installing a telescoping pier foundation system of the present invention.

Flow chart 500 shown in FIG. 12 illustrates a method for deploying or installing the telescoping pier foundation system of the present invention according to an aspect of the present invention.

At step 510, one or more ground anchors may be optionally driven into the installation site for the telescoping pier foundation system.

At step 520, a telescoping pier foundation system is positioned beneath a building structural member, such as, an I-beam. Preferably the stationary portion of the pier foundation system is placed below the frost line for the locale where the installation is taking place.

At step 530, the telescoping member is then raised until the top end of the telescoping member contacts the bottom of the building structural member.

At step 540, the telescoping member is secured to the building structural member using appropriate fastening devices.

At step 550, the internal cavity of the telescoping pier foundation system is filled with a cementitious mixture such as concrete via one or more fill port.

At step 560, the cementitious mixture is allowed to cure, forming the solid core of the resulting composite pier foundation.

In an alternative embodiment, using an embodiment of the telescoping pier foundation system of FIG. 11, where the fill port 50 is provided on the base 11, the outer shell of the pier foundation system may be placed beneath the building structural member and then pump the cementitious mixture into the internal cavity of the outer shell without raising the telescoping member 40. The pressure of the cementitious mixture rising in the internal cavity will then urge the telescoping member 40 from its retracted position upward to engage the bottom of the building structural member. The telescoping member 40 can then be optionally tied to or otherwise secured to the building structural member, as illustrated in FIG. 7.

The composite pier foundation formed using the telescoping pier foundation system according to the present invention is a strong, rigid, structure capable of withstanding uplift and lateral loads better than conventional pier foundation systems used for manufactured home applications. The telescoping pier foundation system of the present invention is both economical and superior in performance to the conventional pier foundations and has an added benefit of rapid installation.

Figure 13:
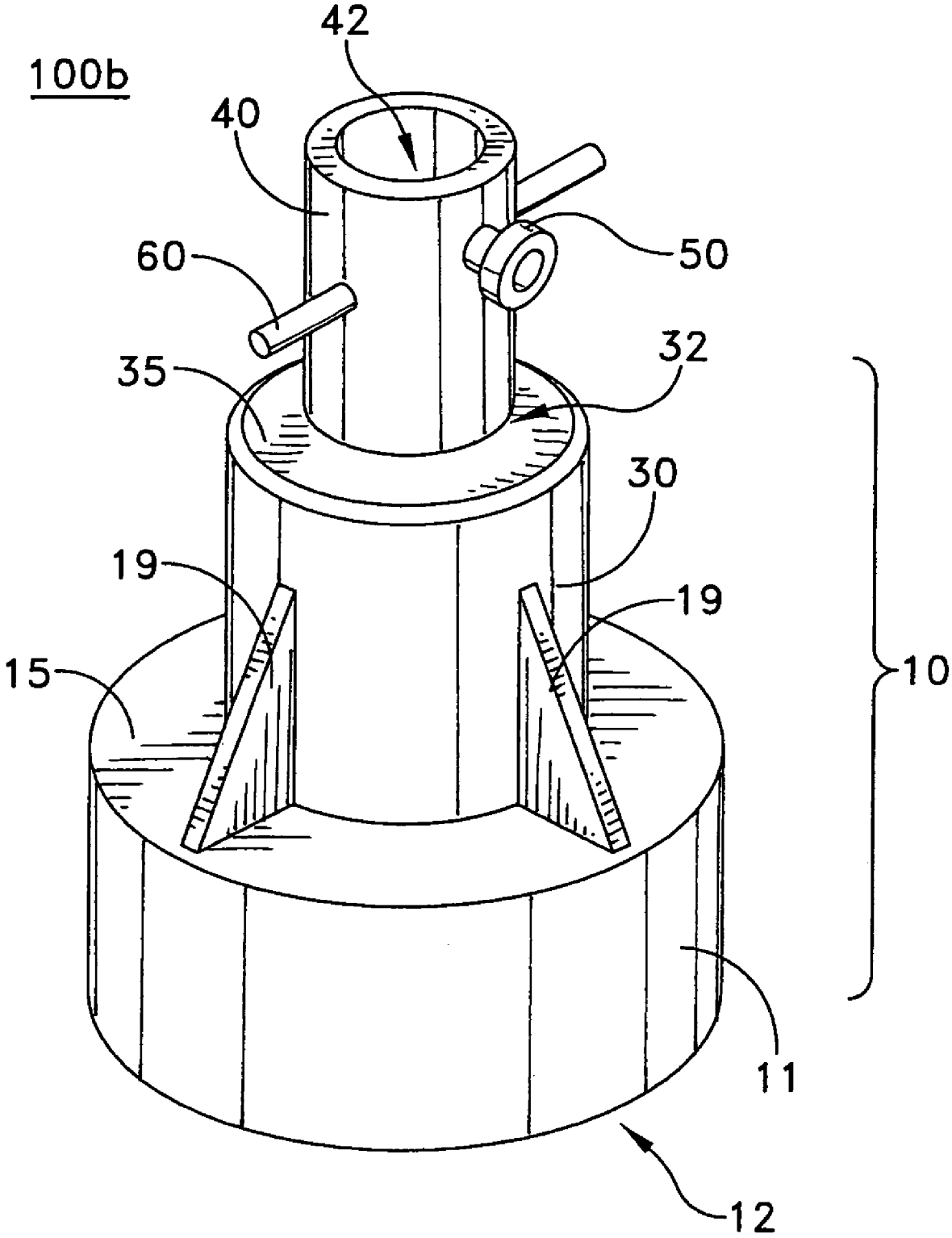
FIG. 13 is a perspective view of another embodiment of the telescoping pier foundation system of the present invention.

FIG. 13 illustrates another embodiment of the present invention where a plurality of reinforcement ribs 19 are provided along the periphery of the column portion 30 joining the column portion 30 and the base 11 of a telescoping pier foundation system 100*b*. Such reinforcement ribs 19 may not be necessary for a finished composite pier foundation that has a solid core of concrete. However, the reinforcement ribs 19 may provide some additional durability to the outer shell assembly during shipping and handling before they are installed. It is understood that the reinforcement ribs 19 may be formed in many different geometrical shape.

According to another aspect of the present invention, the cementitious mixture filling the internal cavity of the telescoping pier foundation system may be reinforced using methods generally known for reinforcing concrete. For example, steel or polymer composite reinforcing bars ("rebars") may be arranged inside the internal cavity of the telescoping pier foundation system so that they will be imbedded in the cementitious mixture. Generally, longitudinally arranged rebars within the telescoping pier foundation system would enhance the lateral load capability of the pier foundation.

While the embodiments shown and described illustrate a telescoping pier foundation system supporting an I-beam, it is understood that a typical manufactured home generally contains two or more I-beams at certain intervals along its length (typically 8 feet). It is contemplated that multiple telescoping pier foundation systems may be used to support each of the I-beam(s) associated with a manufactured building. Still further, parameters such as the outer shell geometry, (i.e. diameter and lengths), thicknesses of the outer shell walls, number and location of the pier foundations and the like may depend on a variety of environmental, structural, economic and load factors associated with the particular application. Note that some of these variables (e.g. outer shell wall thickness and geometry) are also considerations during the installation process. Also, variations associated with the cementitious mixture, such as, its viscosity as impacted by cement, aggregate and water ratios, are also contemplated design parameters depending on the application.

The loads that will act on the fully formed pier foundations may be determined by developing load models for typical manufactured home sizes. For example, manufactured homes are typically supplied in units that are 14 feet×60 feet. These units can be put together to form units that are 28 feet×60 feet, 42 feet×60 feet, etc. The load models will be based on the International Building Code (IBCC, 2000) and ASCE 7 (ASCE, 2000). These references supply guidelines for developing load models for different locations in the United States. The magnitude of the wind loads depend on maximum wind speeds likely to be seen at a given geographic location. As previously mentioned, each manufactured home unit typically contains two I-beams that must be tied to the foundation system at certain intervals along their length (typically 8 feet). Using the load models developed for typical manufactured housing sizes, the load transfer from these I-beams to the pier foundations will be modeled using ANSYS/Structural (ANSYS Inc., 2001). In addition, the transfer of the loads from the piers to the soil or ground surface below will be considered to determine the required size of the rectangular concrete footings of the pier system.

Although illustrated and described herein with reference to certain specific embodiments, the present invention is nevertheless not intended to be limited to the details shown. Various modifications may be made in the details within the scope and range of equivalents of the claims and without departing from the spirit of the invention.

EXAMPLE

A sample of a telescoping pier foundation system, similar to the pier foundation system 100 illustrated in FIG. 1 constructed from PVC material and filled with 4000 psi concrete was tested and certified against the ASCE 7-98 "Minimum Design Loads for Buildings and Other Structures," and HUD-7584, "Permanent Foundations Guide for Manufactured Housing." The base 11 of the sample was about 8.25 inches tall and had an I.D. of 12 inches and a wall thickness of 0.5 inches. The column portion 30 of the sample was about 9.5 inches tall and had an I.D. of 6 inches and a wall thickness of 0.25 inches. The telescoping member 40 had an I.D. of 4 inches and a wall thickness of ¼ inches. Two helical ground anchors were used to anchor the pier foundation. The ground anchors were installed slanted at approximately 20 to 30 degrees from the vertical. They were installed with the slant orientation perpendicular to the long axis of the building structure to maximize lateral load capability of the building structure in the short axis direction. Double-disk double-head helical anchors, model number 4636, available from Minute Man Products, Inc. of East Flat Rock, N.C. were used in this example. The soil was clay-sand, commonly found in many parts of the North American continent. The ultimate uplift load was 4500 pounds. For ultimate lateral loads, the pier foundation system was tested with and without any reinforcement of the concrete using rebars. Without any reinforcement of the concrete, with the telescoping member 40 extended about 6.25 inches so that the total height of the pier foundation is 2 ft., the pier foundation exhibited an ultimate lateral load of 2,000 pounds. With the telescoping member 40 extended about 30.25 inches to a total height of the pier foundation of 4 ft., the ultimate lateral load was 1,000 pounds. With four #3 steel concrete rebars imbedded in the concrete, oriented longitudinally the whole length of the composite pier foundation, the ultimate lateral loads were 6,000, 4,000, and 3,000 pounds at the total pier foundation heights of 2 ft., 3 ft., and 4 ft., respectively.

What is claimed is:

1. A telescoping pier foundation system for forming a composite pier foundation filled with cured cementitious material for supporting a structural member of a building, the system comprising:

a stationary portion of a hollow structure having a solid sidewall and a top end opening;

at least one telescoping member of a hollow structure having, a top open end and a bottom open end, in longitudinal alignment with the stationary portion, residing within the top end opening of the stationary portion and longitudinally movable within the top end opening and extendable through the top end opening;

at least one fill port for receiving a cementitious mixture, wherein the stationary portion and the telescoping member form an outer shell defining an internal cavity in communication with the at least one fill port for receiving the cementitious mixture; and a fastening system for securing the composite pier foundation to the structural member of a building, wherein said fastening system comprises an anchoring portion for anchoring the fastening system to the cementitious mixture filling the internal cavity.

2. The telescoping pier foundation system of claim 1, wherein the fill port for receiving a cementitious mixture is on the telescoping member.

3. The telescoping pier foundation system of claim 2, wherein the fill port for receiving a cementitious mixture is provided near the top end of the telescoping member.

4. The telescoping pier foundation system of claim 1, wherein the fill port for receiving a cementitious mixture comprises a check valve.

5. The telescoping pier foundation system of claim 1, wherein the at least one fill port for receiving a cementitious mixture is provided on the stationary portion.

6. The telescoping pier foundation system of claim 1, further comprising at least one ground anchor for anchoring the composite pier foundation to the ground.

7. The telescoping pier foundation system of claim 6, wherein the at least one ground anchor is a helical anchor.

8. The telescoping pier foundation system of claim 1, wherein the fastening system comprises one or more brackets for engaging the structural member of a building.

9. The telescoping pier foundation system of claim 8, wherein the fastening system further comprises a connector for securing the one or more brackets to the telescoping member.

10. The telescoping pier foundation system of claim 1, wherein the stationary portion comprises:

a base; and a column portion, wherein the top end opening is provided on the column portion.

11. The telescoping pier foundation system of claim 10, wherein the base is made from polyvinylchloride.

12. The telescoping pier foundation system of claim 10, wherein the base is made from a metal alloy.

13. The telescoping pier foundation system of claim 10, wherein the column portion is made from polyvinylchloride.

14. The telescoping pier foundation system of claim 10, wherein the column portion is made from a metal alloy.

15. The telescoping pier foundation system of claim 10, wherein a plurality of reinforcement ribs are provided joining the base and the column portion.

16. The telescoping pier foundation system of claim 1, wherein the stationary portion is made from polyvinylchloride.

17. The telescoping pier foundation system of claim 1, wherein the stationary portion is made from a metal alloy.

18. The telescoping pier foundation system of claim 1, wherein the at least one telescoping member is made from polyvinylchloride.

19. The telescoping pier foundation system of claim 1, wherein the at least one telescoping member is made from a metal alloy.

20. A composite pier foundation for supporting a structural member of a building structure comprising:

an outer shell comprising:

a stationary portion of a hollow structure having a solid sidewall and a top end opening;

at least one telescoping member of a hollow structure having a top open end and a bottom open end, in longitudinal alignment with the stationary portion, residing within the top end opening of the stationary portion, longitudinally movable within the top end opening and extendable through the top end opening;

at least one fill port for receiving a cementitious mixture, wherein the stationary portion and the telescoping portion form the outer shell defining an internal cavity in communication with the at least one fill port for receiving the cementitious mixture:

a core of cured cementitious material substantially filling the internal cavity; and at least one ground anchor having a top portion and a shaft portion, wherein the shaft portion of the wound anchor is driven into the ground beneath the composite pier foundation and the top portion is imbedded in the cured cementitious material.

21. The composite pier foundation of claim 20, wherein the stationary portion is made from polyvinylchloride.

22. The composite pier foundation of claim 20, wherein the at least one telescoping member is made from polyvinylchloride.

23. The composite pier foundation of claim 20, wherein the stationary portion is made from a metal alloy.

24. The composite pier foundation of claim 20, wherein the at least one telescoping member is made from a metal alloy.

25. The composite pier foundation of claim 20, wherein the stationary portion comprises:

a base; and a column portion, wherein the top end opening is provided on the column portion.

26. The composite pier foundation of claim 25, wherein the base is made from polyvinylchloride.

27. The composite pier foundation of claim 25, wherein the base is made from a metal alloy.

28. The composite pier foundation of claim 25, wherein the column portion is made from polyvinylchloride.

29. The composite pier foundation of claim 25, wherein the column portion is made from a metal alloy.

30. The composite pier foundation of claim 20, wherein the cured cementitious mixture is concrete.

31. The composite pier foundation of claim 20, wherein the at least one telescoping member comprises a fastening system for securing the telescoping member to a structural member of a building.

32. The composite pier foundation of claim 31, wherein the fastening system comprises one or more brackets for engaging the structural member of a building.

33. The composite pier foundation of claim 32, wherein the fastening system further comprises a connector for securing the one or more brackets to the telescoping member.

34. The composite pier foundation of claim 31, wherein the fastening system comprises an anchoring portion for anchoring the fastening system to the cementitious mixture filling the internal cavity.

35. A method of installing a telescoping pier foundation system, the method comprising:

driving at least one ground anchor having a top portion into the ground beneath a structural member of a building;

positioning an outer shell of the telescoping pier foundation system beneath the structural member of the building, the outer shell having an internal cavity, wherein the positioned outer shell covers the at least one ground anchor and the top portion of the at least one ground anchor extends into the internal cavity of the outer shell;

raising a telescoping member of the outer shell until the telescoping member contacts the structural member of the building;

securing the telescoping member to the structural member of the building;

filling the internal cavity of the outer shell substantially fully with a cementitious mixture; and allowing the cementitious mixture to cure forming a composite pier foundation, wherein the top portion of the at least one ground anchor is embedded within the cured cementitious mixture.

36. The method of claim 35, wherein the step of securing the telescoping member to the structural member of the building requires the use of a fastening system that connects directly to the telescoping member.

37. A telescoping pier foundation system for forming a composite pier foundation filled with cured cementitious material for supporting a structural member of a building, the system comprising:

a stationary portion of a hollow structure having a solid sidewall and a top end opening;

at least one telescoping member of a hollow structure having, a top open end and a bottom open end, in longitudinal alignment with the stationary portion, residing within the top end opening of the stationary portion and longitudinally movable within the top end opening and extendable through the top end opening;

at least one fill port for receiving a cementitious mixture, wherein the stationary portion and the telescoping member form an outer shell defining an internal cavity in communication with the at least one fill port for receiving the cementitious mixture, wherein the stationary portion comprises a base and a column portion, wherein the top end opening of the stationary portion is provided on the column portion and a plurality of reinforcement ribs are provided joining the base and the column portion.

38. A telescoping pier foundation system for forming a composite pier foundation filled with cured cementitious material for supporting a structural member of a building, the system comprising:

a stationary portion of a hollow structure having a solid sidewall and a top end opening;

at least one telescoping member of a hollow structure having, a top open end and a bottom open end, in longitudinal alignment with the stationary portion, residing within the top end opening of the stationary portion and longitudinally movable within the top end opening and extendable through the top end opening;

at least one fill port for receiving a cementitious mixture, wherein the stationary portion and the telescoping member form an outer shell defining an internal cavity in communication with the at least one fill port for receiving the cementitious mixture; and at least one ground anchor having a top portion and a shaft portion, wherein the shaft portion of the ground anchor gets driven into the ground beneath the composite pier foundation and the top portion is imbedded in the cured cementitious material when the telescoping pier foundation system is installed.

39. A composite pier foundation for supporting a structural member of a building structure comprising:

an outer shell comprising:

a stationary portion of a hollow structure having a solid sidewall and a top end opening;

at least one telescoping member of a hollow structure having a top open end and a bottom open end, in longitudinal alignment with the stationary portion, residing within the top end opening of the stationary portion, longitudinally movable within the top end opening and extendable through the top end opening;

at least one fill port for receiving a cementitious mixture, wherein the stationary portion and the telescoping portion form the outer shell defining an internal cavity in communication with the at least one fill port for receiving the cementitious mixture;

a core of cured cementitious material substantially filling the internal cavity; and a fastening system for securing the telescoping member to a structural member of a building, wherein said fastening system comprises an anchoring portion for anchoring the fastening system to the cementitious mixture filling the internal cavity.

40. A method of installing a telescoping pier foundation system, the method comprising:

positioning an outer shell of the telescoping pier foundation system beneath a structural member of a building, the outer shell defining an internal cavity;

securing a fastening system to the structural member of the building, wherein the fastening system comprises an anchoring portion for anchoring the fastening system to a cementitious mixture filling the internal cavity;

raising a telescoping member of the outer shell until the anchoring portion of the fastening system extends into the telescoping member;

filling the internal cavity of the outer shell substantially fully with a cementitious mixture; and allowing the cementitious mixture to cure forming a composite pier foundation.

41. The method of claim 40, further comprising the steps of:

driving at least one ground anchor having a top portion into the ground beneath a structural member of a building before positioning the outer shell of the telescoping pier foundation system beneath the structural member of the building, wherein the positioned outer shell covers the at least one ground anchor and the top portion of the at least one ground anchor extends into the internal cavity of the outer shell and the top portion of the at least one ground anchor is embedded within the cured cementitious mixture.

* * * * *

UNITED STATES PATENT AND TRADEMARK OFFICE

CERTIFICATE OF CORRECTION

PATENT NO. : 7,191,569 B2
APPLICATION NO. : 10/797615
DATED : March 20, 2007
INVENTOR(S) : Michael Jerry Brown It is certified that error appears in the above-identified patent and that said Letters Patent is hereby corrected as shown below:

On Title page

Item (73) is incorrect as it appears. Please enter item number (73) as follows:

(73) Assignee: Telepier Foundations LLC, Atlanta, GA (US)

Column 13, Line 6 is incorrect as it appears. Please enter Column 13, Line 6 as follows:

shaft portion of the ground anchor is driven into the

Signed and Sealed this

First Day of May, 2007

JON W. DUDAS
*Director of the United States Patent and Trademark Office*